US008607810B1

(12) United States Patent
Chung

(10) Patent No.: US 8,607,810 B1
(45) Date of Patent: Dec. 17, 2013

(54) COLLAPSIBLE SHELTER FOR AUTOMOBILE

(76) Inventor: Chao-Tang Chung, Taoyuan (TW)

( * ) Notice: Subject to any disclaimer, the term of this patent is extended or adjusted under 35 U.S.C. 154(b) by 0 days.

(21) Appl. No.: 13/602,200

(22) Filed: Sep. 3, 2012

(51) Int. Cl.
*E04H 15/06* (2006.01)

(52) U.S. Cl.
USPC ..... 135/88.06; 135/88.13

(58) Field of Classification Search
USPC ..... 135/88.06, 88.13; 296/136.1, 136.11, 296/136.12, 136.13
See application file for complete search history.

(56) References Cited

U.S. PATENT DOCUMENTS 4,605,030 A * 8/1986 Johnson ..... 135/88.06
4,655,236 A * 4/1987 Dorame et al. ..... 135/88.06
5,241,977 A * 9/1993 Flores et al. ..... 135/88.06
5,295,500 A * 3/1994 Leu ..... 135/88.06
5,579,796 A * 12/1996 Mallo et al. ..... 135/88.06
5,857,477 A * 1/1999 James ..... 135/88.06
7,172,234 B2 * 2/2007 Chang ..... 296/95.1
7,546,844 B2 * 6/2009 Al-Mutairi ..... 135/88.06
7,946,306 B2 * 5/2011 Ampoyo ..... 135/88.06

* cited by examiner

*Primary Examiner* — Noah Chandler Hawk

(57) ABSTRACT

A collapsible shelter for vehicle includes four base plates each releasably pressed by one of four wheels of the vehicle, each base plate including an inclined front end and an outwardly inclined support tube; four telescopic posts each having a bottom end releasably fastened in the support tube; a canopy including a top, front and rear end members, two side members, four holes through the top, the holes being for allowing externally threaded top ends of the posts to pass through, four nuts each threadedly secured to the externally threaded top end, and two tubular members between edges of the top and the side members respectively; and two telescopic rods inserted into the tubular members respectively.

8 Claims, 12 Drawing Sheets

COLLAPSIBLE SHELTER FOR AUTOMOBILE

BACKGROUND OF THE INVENTION

1. Field of the Invention

The invention relates to portable shelters and more particularly to a collapsible shelter for automobile.

2. Description of Related Art

Collapsible structures or shelters providing protection against sun, rain, and the like are well known. The structure typically comprises a fabric canopy, a frame for supporting the canopy, and legs for supporting the frame above the ground. One significant use for the collapsible structure is to provide temporary protection when servicing a motor vehicle. The principal advantage of collapsible structure is its portability.

However, the conventional collapsible structures are quite complicated. Thus, the need for improvement still exists.

SUMMARY OF THE INVENTION

It is therefore one object of the invention to provide a portable shelter for a vehicle comprising four base plates each releasably pressed by one of four wheels of the vehicle, each base plate comprising an inclined front end and an outwardly inclined support tube; four telescopic posts each having a bottom end releasably fastened in the support tube; a canopy comprising a top, front and rear end members oriented downward, two side members oriented downward, four holes through the top for allowing externally threaded top ends of the posts to pass through, four nuts each threadedly secured to the externally threaded top end of each post, and two tubular members wherein one tubular member is formed between one side of the top and one side member and other tubular member is formed between the other side of the top and the other side member; and two telescopic rods inserted into the tubular members respectively.

The above and other objects, features and advantages of the invention will become apparent from the following detailed description taken with the accompanying drawings.

DETAILED DESCRIPTION OF THE INVENTION

Figure 1:
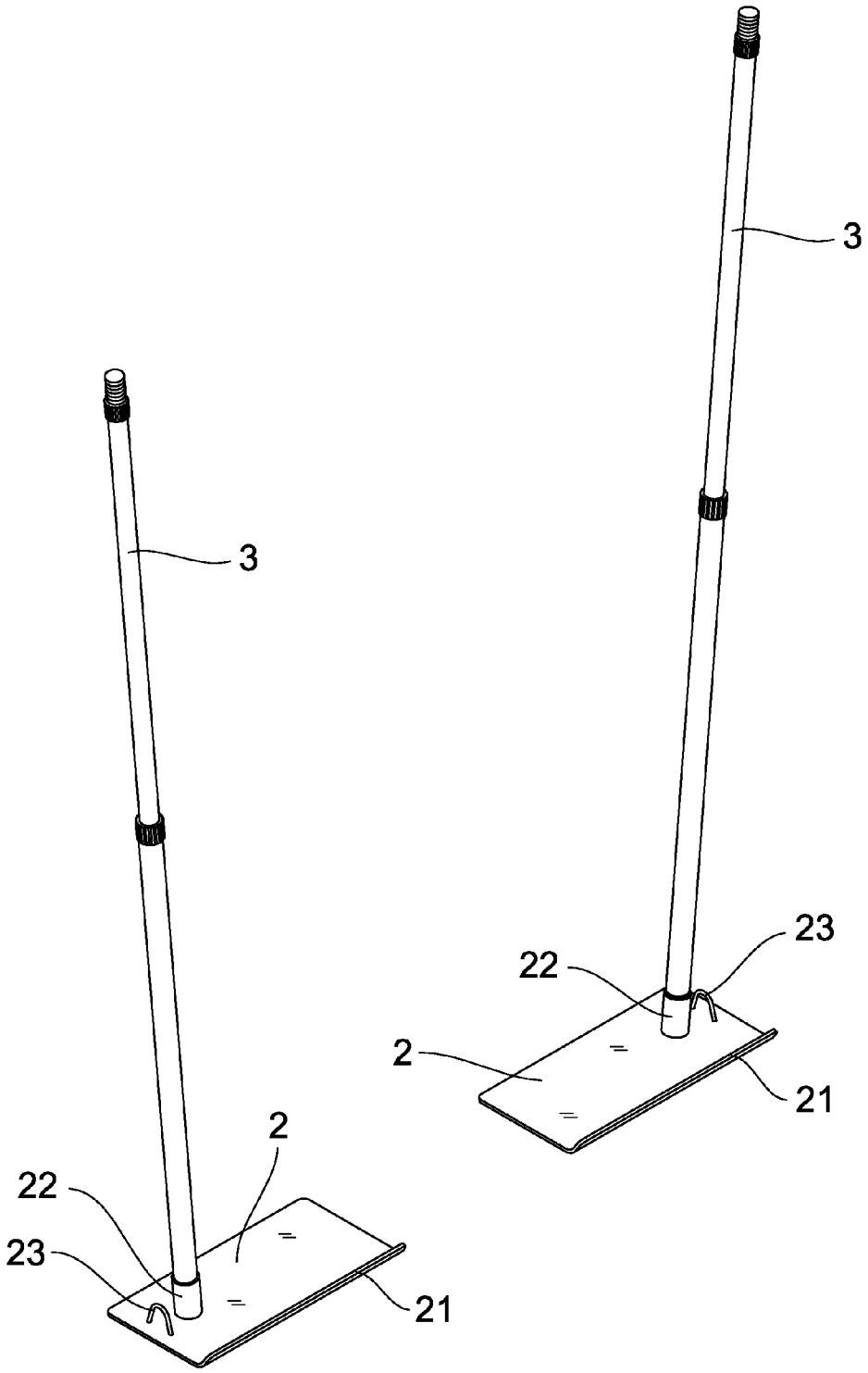
FIG. 1 is a perspective view of two sets of assembled base plate and telescopic post of a collapsible shelter for automobile according to a first preferred embodiment of the invention.
Figure 2:
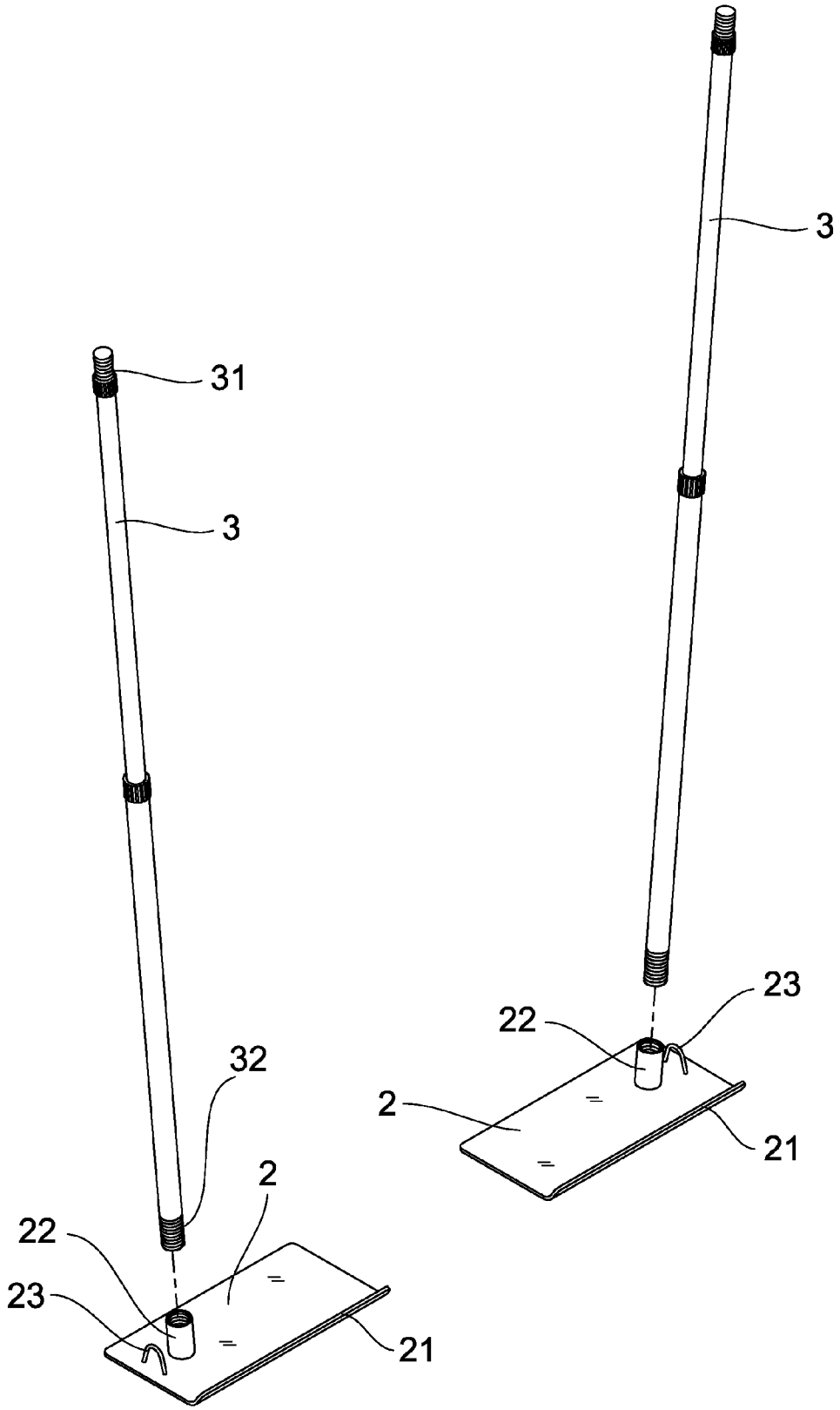
FIG. 2 is an exploded view of FIG. 1.
Figure 3:
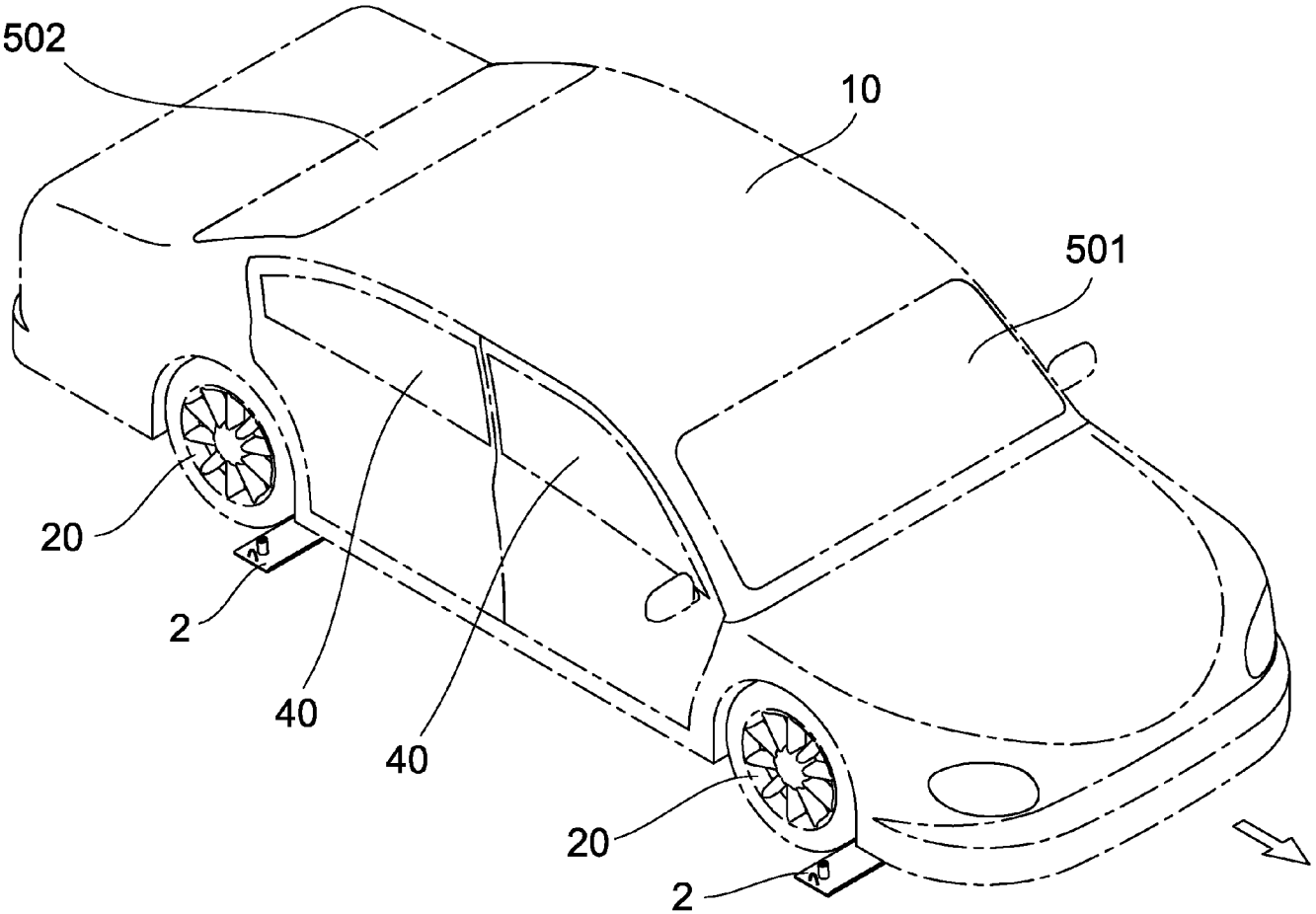
FIG. 3 is a perspective view of an automobile with four base plates to be pressed by wheels.
Figure 4:
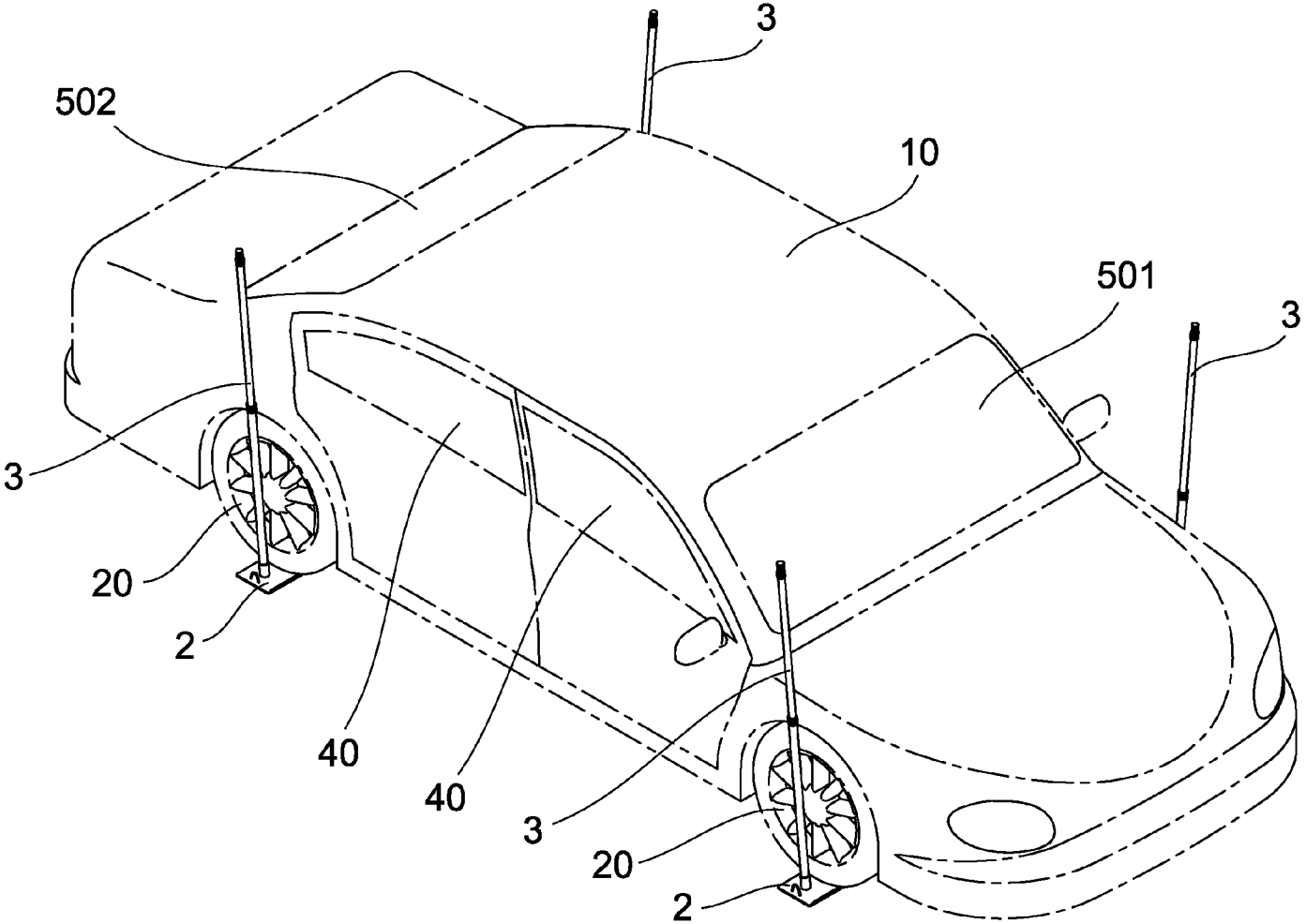
FIG. 4 is a view similar to FIG. 3 showing the four base plates pressed by the wheels and the telescopic posts fastened in support tubes of the base plates.
Figure 5:
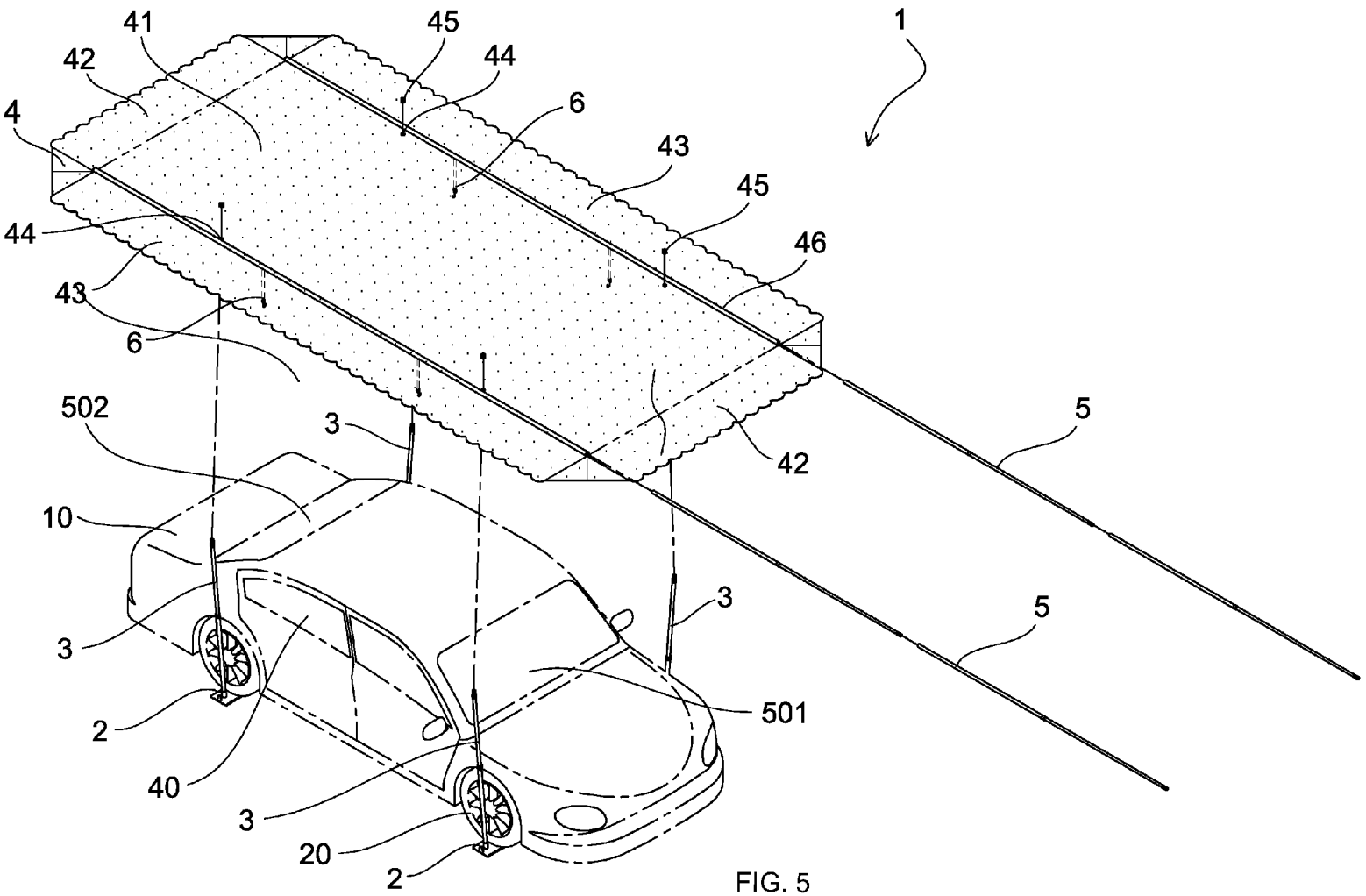
FIG. 5 is a perspective view showing a canopy to be secured to tops of the telescopic posts of FIG. 4.
Figure 6:
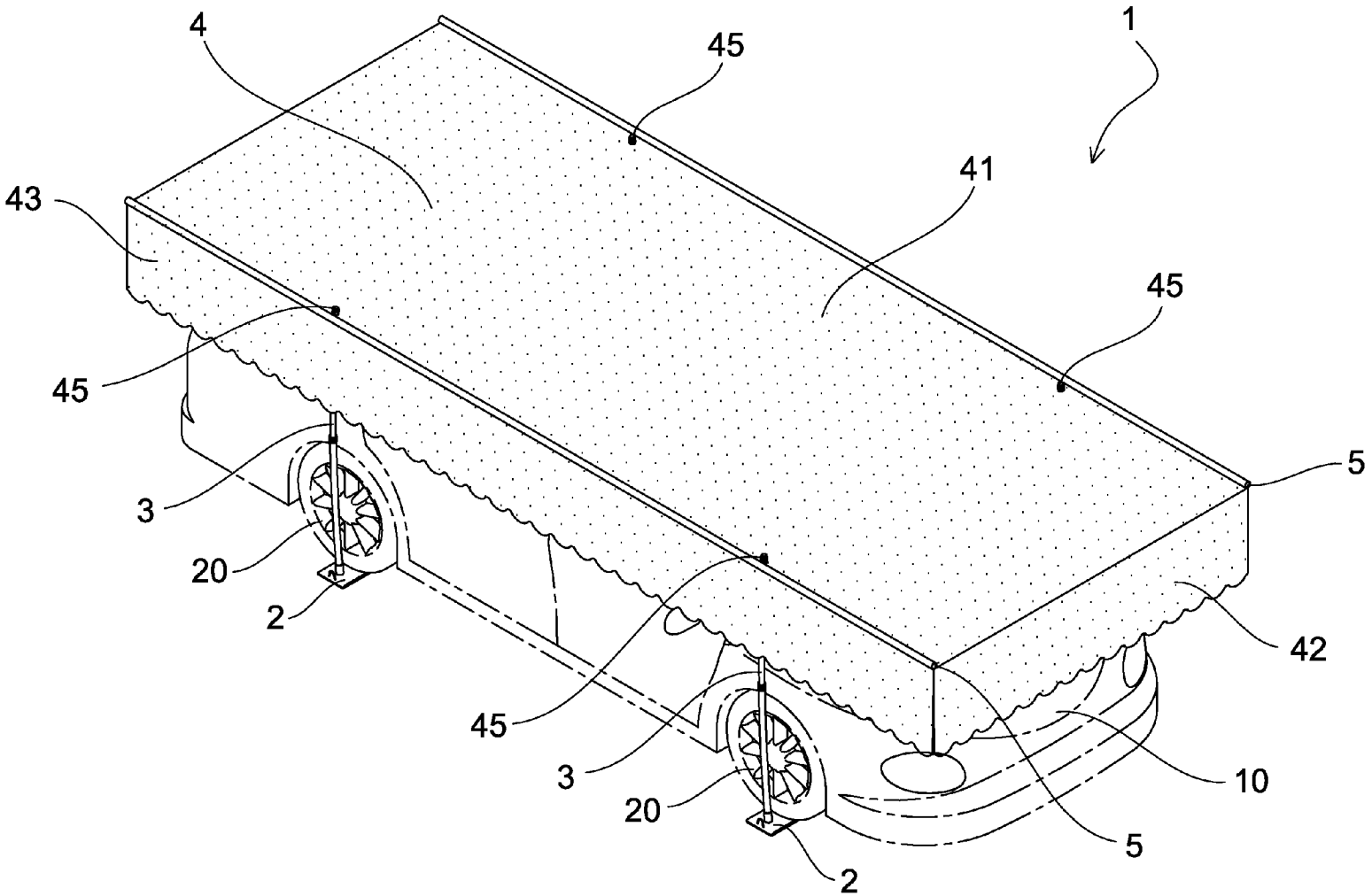
FIG. 6 is a perspective view of the assembled shelter with the automobile being protected.
Figure 7:
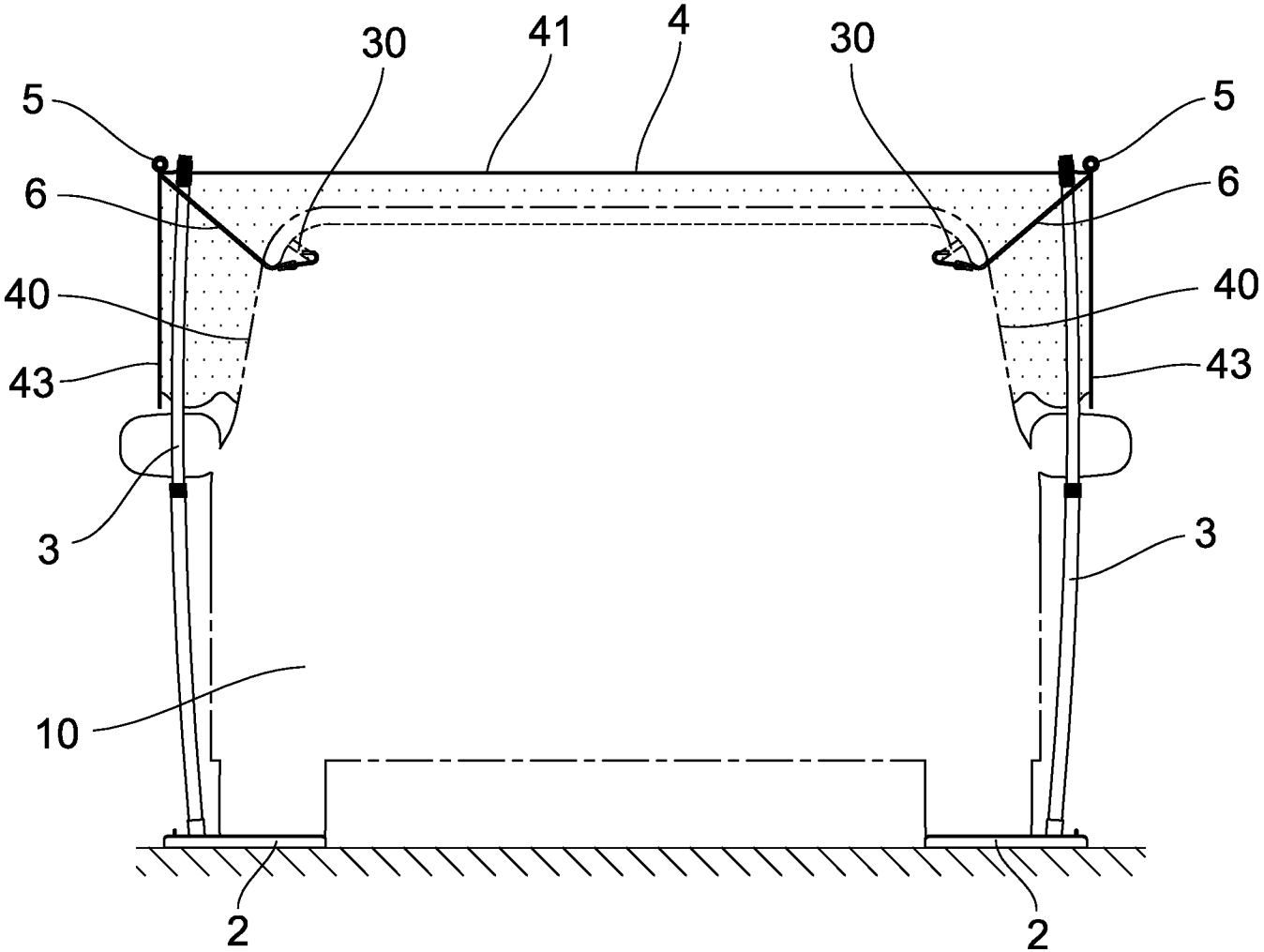
FIG. 7 is a schematic front view of FIG. 6.
Figure 8:
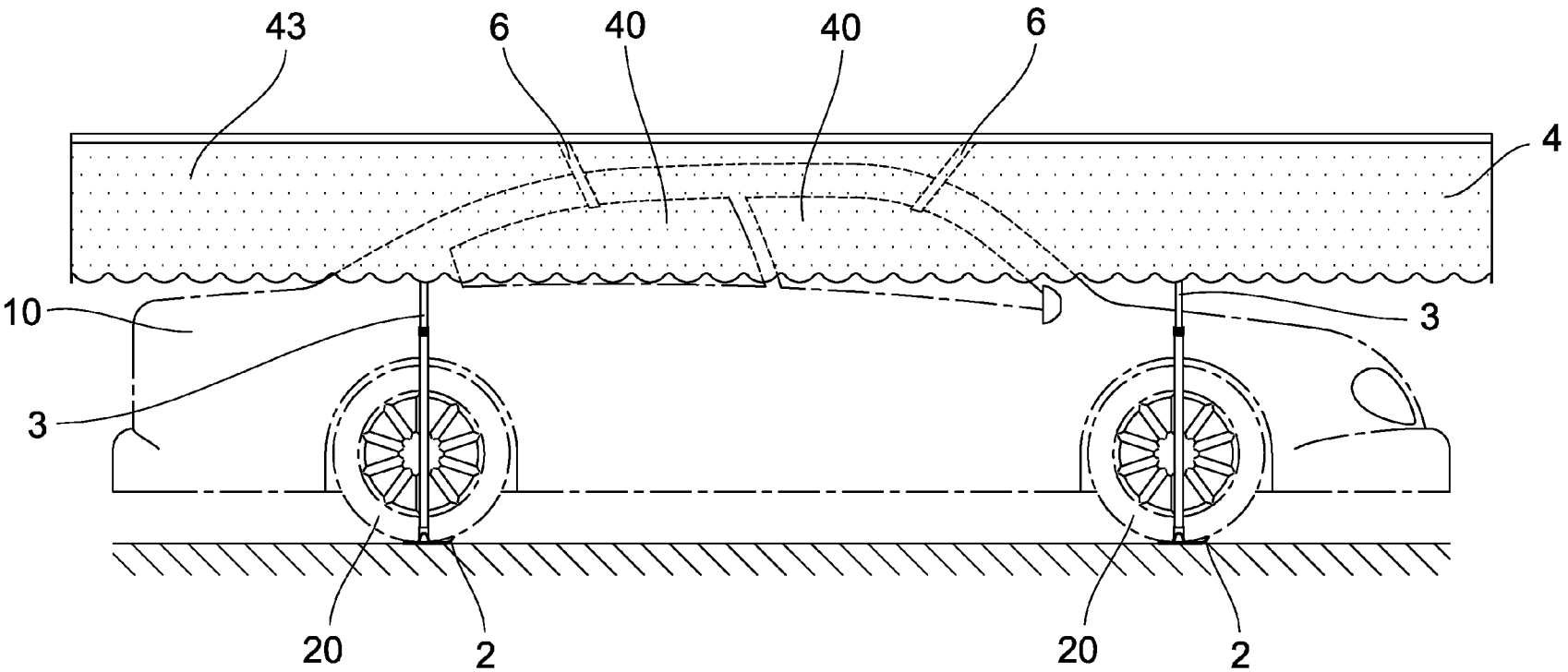
FIG. 8 is a side elevation of FIG. 6.
Figure 9:
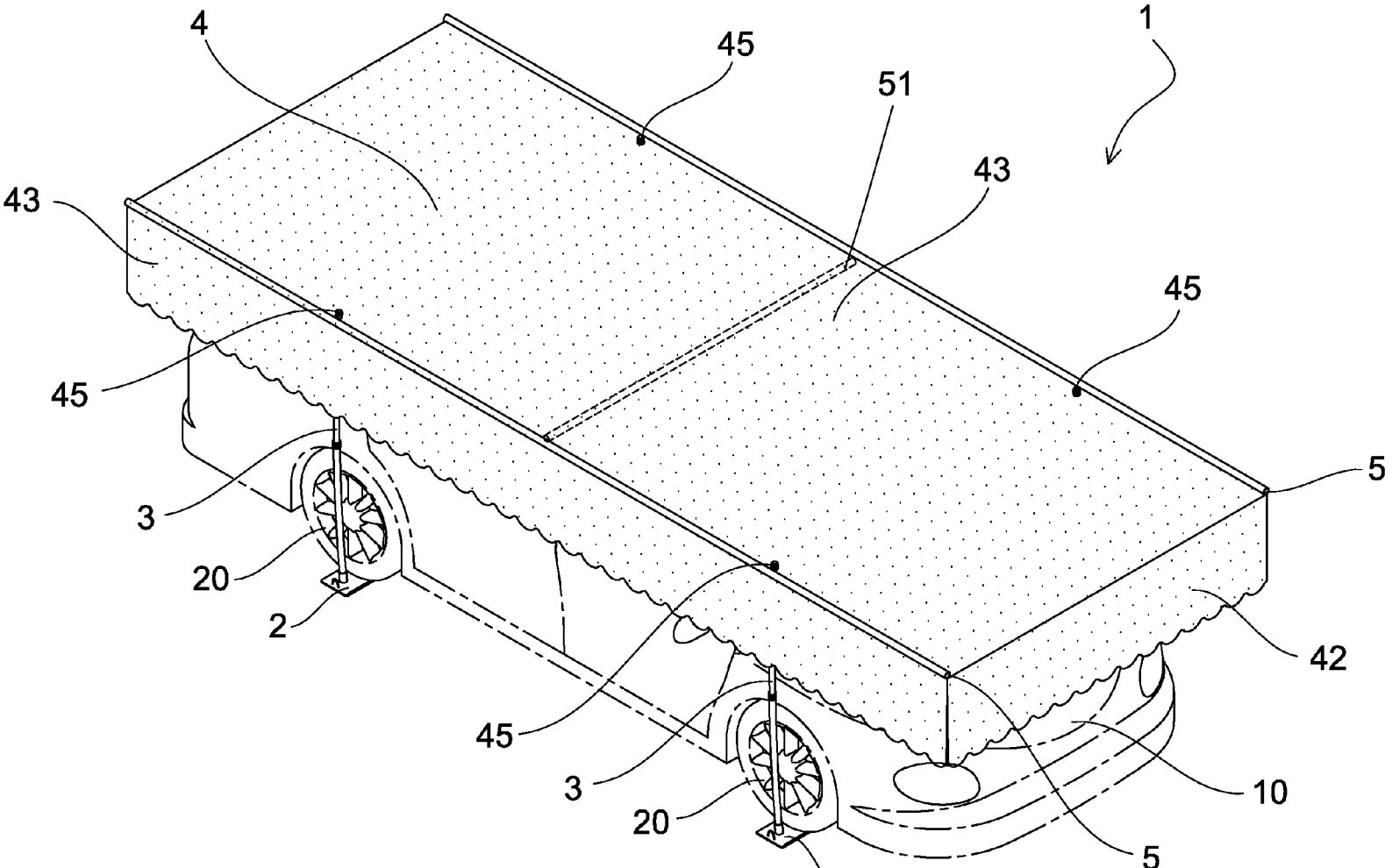
FIG. 9 is a view similar to FIG. 6 showing the provision of a cross member between midpoints of telescopic rods.

Referring to FIGS. 1 to 9, a collapsible shelter 1 for providing temporary protection of automobile 10 in accordance with the invention comprises the following components as discussed in detail below.

Four rectangular base plates 2 are made of aluminum and each is pressed by one of four wheels 20 of the automobile 10. The base plate 2 comprises an inclined front end 21, an internally threaded support tube 22 proximate to one side (i.e., outer side), the support tube 22 being outwardly inclined, and an arch 23 formed between the support tube 22 and one side, the arch 23 being adapted to allow a person to place the base plate 2 under the wheel 20 prior to installation or disengage the base plate 2 from the wheel 20 prior to disassembly of the shelter 1. Four telescopic posts 3 each has externally threaded top and bottom ends 31, 32 in which the bottom end 32 is threadedly fastened in the support tube 22.

A canopy 4 is made of fabric and comprises a rectangular top 41, rectangular front and rear end members 42 oriented downward for covering windshield 501 and rear window 502 of the automobile 10 respectively, two side members 43 oriented downward for covering windows 40 of the automobile 10, four holes 44 through the top 41, the holes 44 being arranged as four corners of a rectangle and adapted to allow the top ends 31 of the posts 3 to pass through, four threaded nuts 45 each threadedly secured to the top end 31 for fastening the posts 3 and the canopy 4 together, and two tubular members 46 formed between one edge of the top 41 and one side member 43 and between the other edge of the top 41 and the other side member 43 respectively. It is noted that the posts 3 are not completely straight in its assembly state due to the provision of the upwardly inclined support tubes 22. Thus, the posts 3 are slightly bent outwardly.

Two telescopic rods 5 are adapted to insert into the tubular members 46 for increasing the structural strength of the canopy 4. Further, a cross member 51 may be provided between midpoints of the rods 5 as an enhancement. Four straps 6 each has one end secured to the side member 43 and the other end releasably secured to a grip 30 on an internal wall of the automobile 10. This can further secure the canopy 4 to the automobile 10.

Figure 10:
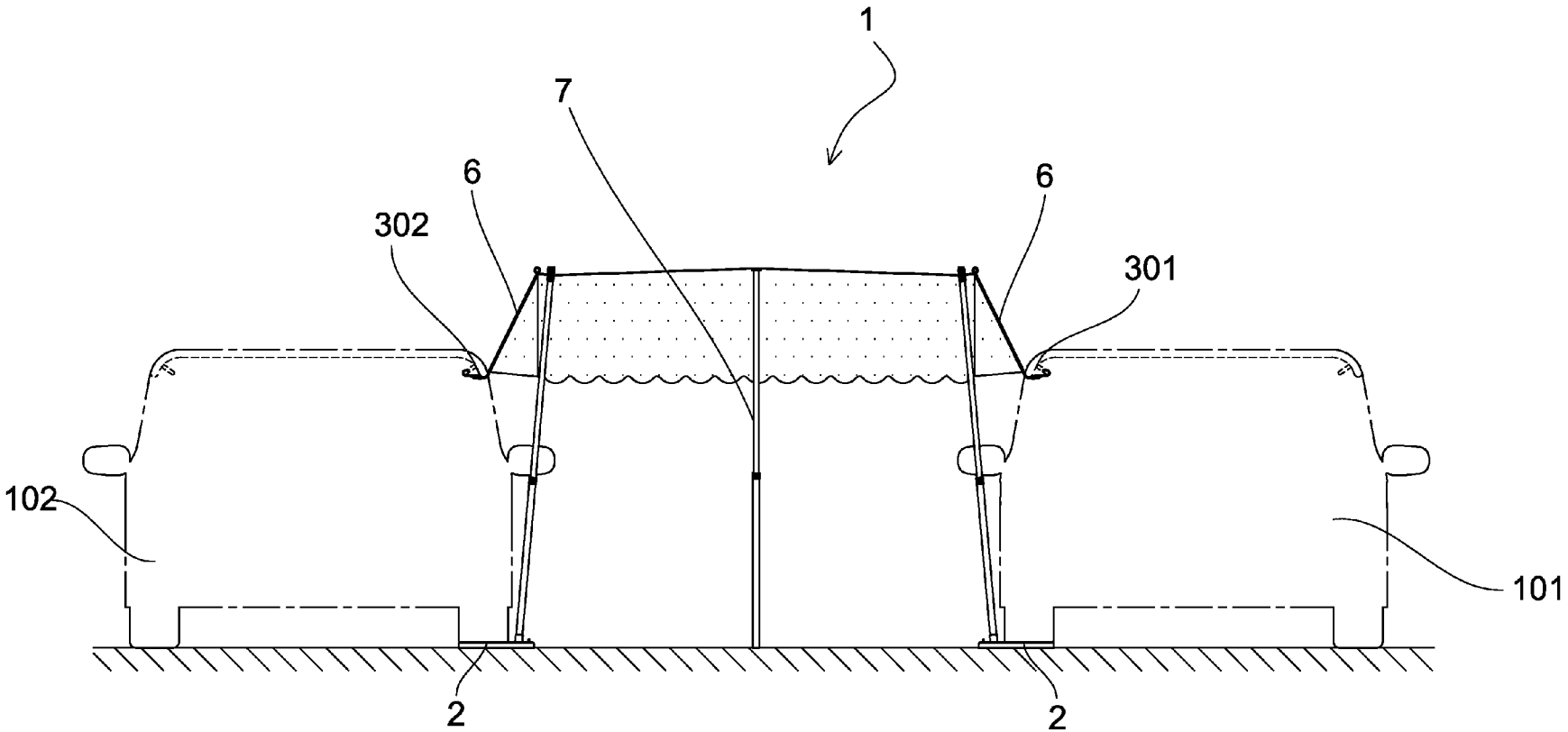
FIG. 10 is a schematic front view of a collapsible shelter according to a second preferred embodiment of the invention.

Referring to FIG. 10, a collapsible shelter 1 in accordance with a second preferred embodiment of the invention is shown. The characteristics of the second preferred embodiment are substantially the same as that of the first preferred embodiment except the following:

The shelter 1 is employed as a tent disposed between two parallel automobiles 101 and 102. A telescopic post member 7 is provided to support a center of the canopy 4 above the ground. Two base plates 2 of one group are pressed by two wheels of the same side of one automobile 101 and two base plates 2 of the other group are pressed by two wheels of the same side of the other automobile 101. Two straps 6 of one group each has one end releasably secured to a grip 301 of one automobile 101 and two straps 6 of the other group each has one end releasably secured to a grip 302 of the other automobile 102.

Figure 11:
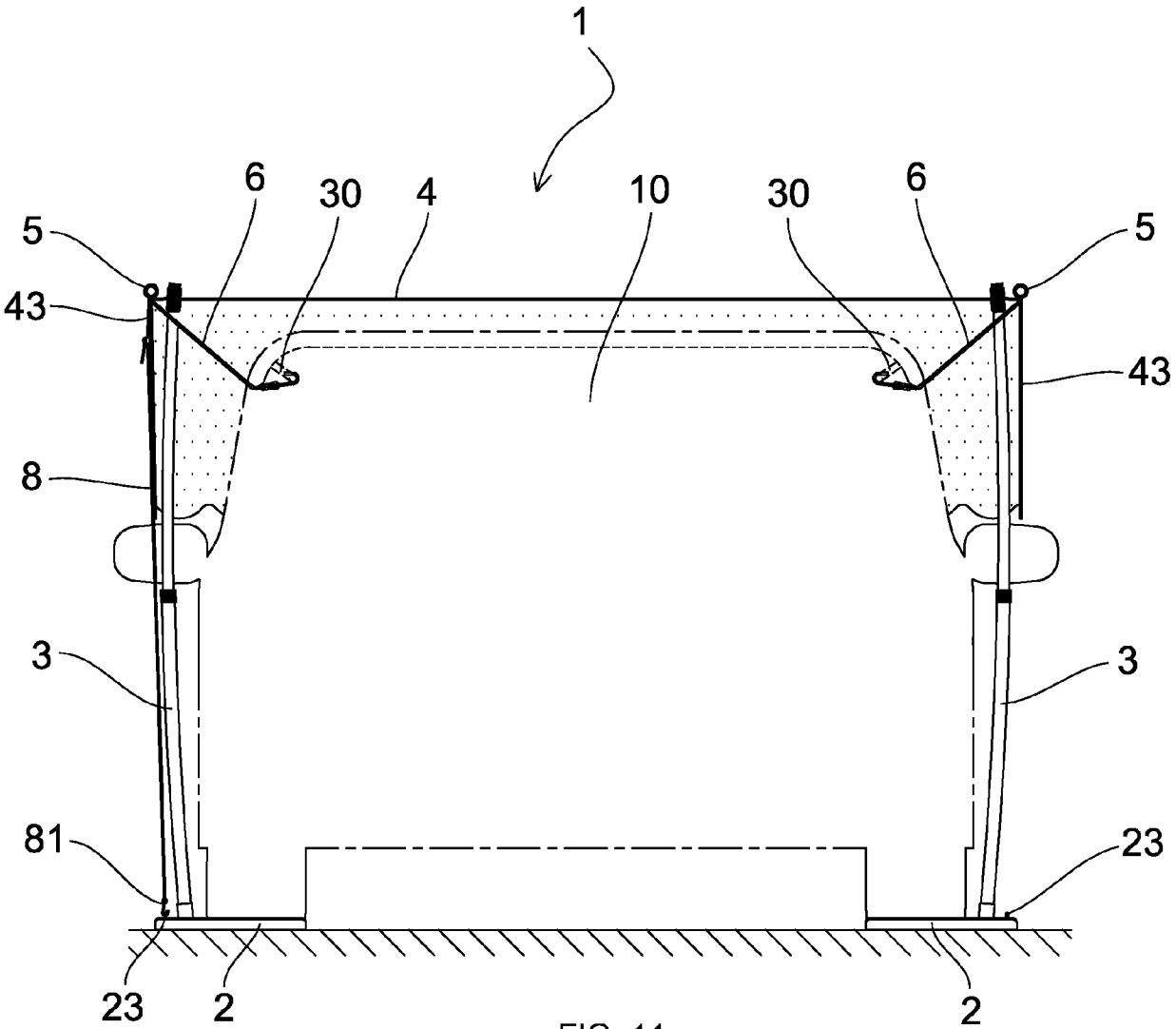
FIG. 11 is a schematic front view of a collapsible shelter for automobile according to a third preferred embodiment of the invention.
Figure 12:
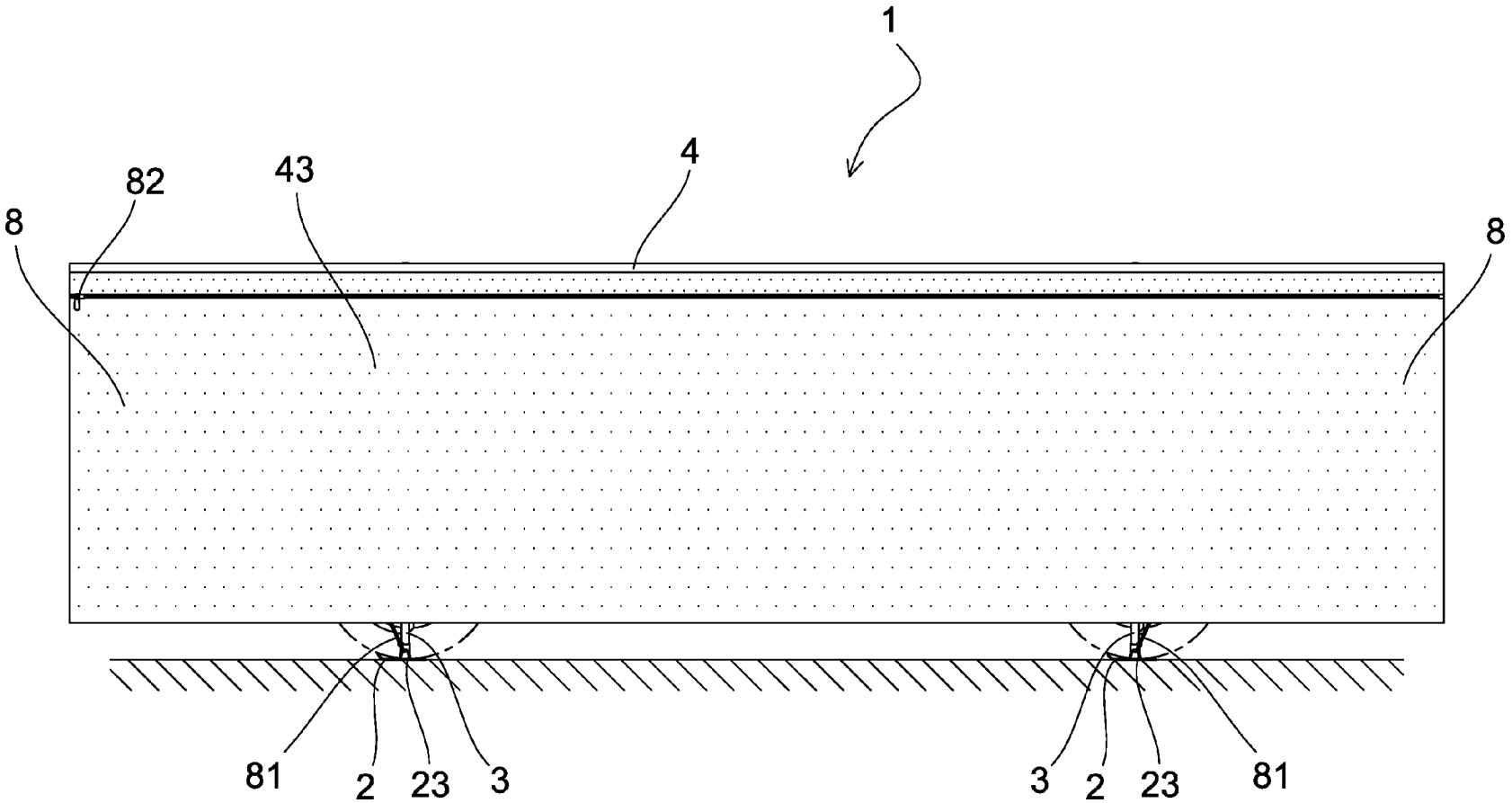
FIG. 12 is a side elevation of FIG. 11.

Referring to FIGS. 11 and 12, a collapsible shelter 1 for automobile 10 in accordance with a third preferred embodiment of the invention is shown. The characteristics of the third preferred embodiment are substantially the same as that of the first preferred embodiment except the following:

A rectangular advertisement fabric 8 is provided and has a top edge releasably secured to one side member 43 (e.g., by a zipper 82) and a bottom edge formed with two strap members 81 releasably secured to the arches 23 respectively.

While the invention has been described in terms of preferred embodiments, those skilled in the art will recognize that the invention can be practiced with modifications within the spirit and scope of the appended claims.

What is claimed is:

1. A portable shelter for a vehicle comprising:

four base plates each releasably pressed by one of four wheels of the vehicle, each base plate comprising an inclined front end and an outwardly inclined support tube;

four telescopic posts each having a bottom end releasably fastened in the support tube;

a canopy comprising a top, front and rear end members oriented downward, two side members oriented downward, four holes through the top for allowing externally threaded top ends of the telescopic posts to pass through, four threaded nuts each threadedly secured to the externally threaded top end of each telescopic post, and two tubular members wherein one tubular member is formed between one side of the top and one side member and other tubular member is formed between the other side of the top and the other side member; and two telescopic rods inserted into the tubular members respectively.

2. The portable shelter of claim 1, further comprising four straps each having one end secured to the side member and the other end releasably secured to a grip of the vehicle.

3. The portable shelter of claim 1, wherein each base plate further comprises an attachment member formed adjacent to the support tube.

4. The portable shelter of claim 3, further comprising an advertisement fabric having a top edge releasably secured to one side member and a bottom edge formed with two strap members releasably secured to the attachment members respectively.

5. The portable shelter of claim 4, wherein the advertisement fabric has its top edge releasably secured to one side member by using a zipper.

6. The portable shelter of claim 1, wherein the front and rear end members cover a windshield of the vehicle and a rear window of the vehicle respectively, and the side members cover windows of the vehicle respectively.

7. The portable shelter of claim 1, further comprising a telescopic post member for supporting about center of the canopy above the ground.

8. The portable shelter of claim 1, further comprising a cross member interconnecting about midpoints of the telescopic rods.

* * * * *